United States Patent [19]

Salazar et al.

[11] Patent Number: 5,075,852

[45] Date of Patent: Dec. 24, 1991

[54] FRAUD DETECTION IN POSTAGE METER HAVING UNSECURED PRINT WHEELS

[75] Inventors: Edilberto I. Salazar, Brookfield; Sandra J. Peterson, East Norwalk, both of Conn.

[73] Assignee: Pitney Bowes Inc., Stamford, Conn.

[21] Appl. No.: 423,812

[22] Filed: Oct. 18, 1989

[51] Int. Cl.[5] ..... G07B 17/04

[52] U.S. Cl. ..... 364/464.02

[58] Field of Search ..... 235/103; 364/464.02; 377/15

[56] References Cited

U.S. PATENT DOCUMENTS

| | | | |
|---|---|---|---|
| 2,526,441 | 10/1950 | Whitmore et al. | 377/15 |
| 2,543,531 | 2/1951 | Lang | 377/15 X |
| 4,630,210 | 12/1986 | Salazar et al. | 101/91 X |
| 4,631,681 | 12/1986 | Salazar et al. | 318/604 X |
| 4,635,205 | 1/1987 | Eckert, Jr. et al. | 318/696 X |
| 4,636,959 | 1/1987 | Salazar et al. | 101/91 X |
| 4,638,732 | 1/1987 | Salazar et al. | 101/91 |
| 4,646,635 | 3/1987 | Salazar et al. | 364/466 X |
| 4,665,353 | 5/1987 | Salazar et al. | 318/599 |
| 4,731,728 | 3/1988 | Muller | 364/466 |
| 4,774,446 | 9/1988 | Salazar et al. | 318/561 |

FOREIGN PATENT DOCUMENTS 17406 10/1980 European Pat. Off. .

OTHER PUBLICATIONS

"Tips for Applying Servo Positioning Systems", by Furr et al.; Machine Design; Mar. 24, 1988, pp. 70–73.

*Primary Examiner*—Parshotam S. Lall
*Assistant Examiner*—Edward R. Cosimano
*Attorney, Agent, or Firm*—Charles G. Parks, Jr.; David E. Pitchenik; Melvin J. Scolnick

[57] ABSTRACT

A postage meter is disclosed which determines whether postage was printed while power to the meter was off, and if so accounts for such postage printing. The postage meter also determines whether such printing resulted from tampering, and if so records each instance of such tampering. When the number of instances exceeds a predetermined number, the meter prevents further normal operation thereof. The postage meter is provided structure and programming to accomplish the foregoing because it does not include a print device locking mechanism that locks the print devices when power to the meter is switched off. The postage meter determines print cycles of the postage meter occurring when power to the meter is switched off and whether the print devices were moved to a different postage value setting when the meter was off, and if so, the new setting of the print devices. From that, the postage meter determines whether postage was printed while power to the meter was switched off, and if so, accounts for the postage printed.

17 Claims, 6 Drawing Sheets

FULL-DIGIT QUADRATURE STATE = 00

1 ENCODER TRANSITION = 1/4 MOTOR REV

MAXIMUM OFFSET DISTANCE = 1/2 MOTOR REV

MAXIMUM ENCODER TRANSITION = 3 COUNT PER OFFSET DISTANCE

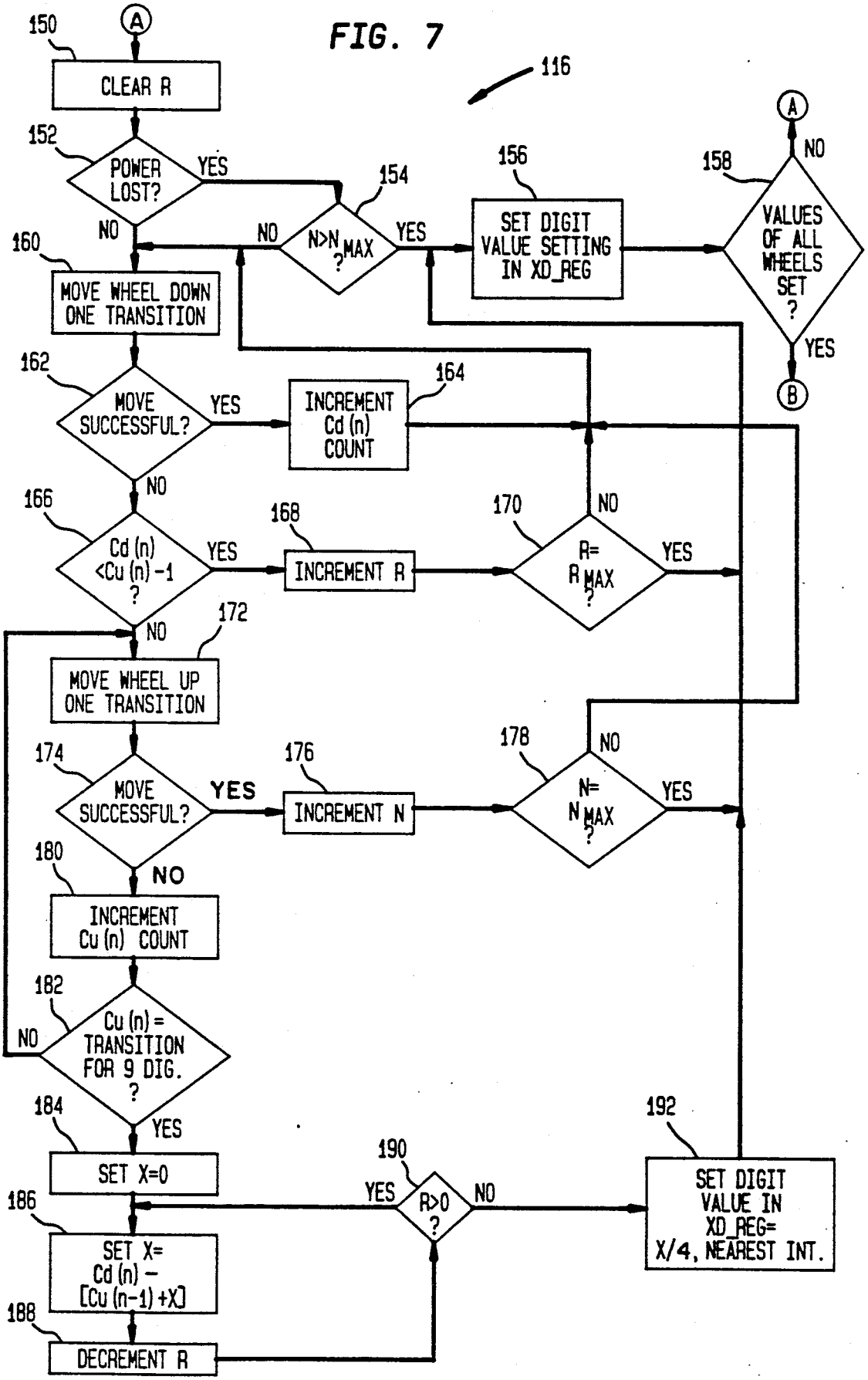
FIG. 7
116
150
A
CLEAR R
152
POWER LOST?
YES
NO
154
N>N MAX ?
NO
YES
156
SET DIGIT VALUE SETTING IN XD_REG
158
VALUES OF ALL WHEELS SET ?
NO
YES
A
B
160
MOVE WHEEL DOWN ONE TRANSITION
162
MOVE SUCCESSFUL?
YES
NO
164
INCREMENT Cd (n) COUNT
166
Cd (n) <Cu (n) -1 ?
YES
NO
168
INCREMENT R
170
R= R MAX ?
NO
YES
172
MOVE WHEEL UP ONE TRANSITION
174
MOVE SUCCESSFUL?
YES
NO
176
INCREMENT N
178
N= N MAX ?
NO
YES
180
INCREMENT Cu (n) COUNT
182
Cu (n) = TRANSITION FOR 9 DIG. ?
NO
YES
184
SET X=0
186
SET X= Cd (n) - [Cu (n-1) +X]
188
DECREMENT R
190
R>0 ?
YES
NO
192
SET DIGIT VALUE IN XD_REG= X/4, NEAREST INT.

FRAUD DETECTION IN POSTAGE METER HAVING UNSECURED PRINT WHEELS

RELATED APPLICATIONS

The following applications, all assigned to the assignee of this application, are related to this application: Ser. No. 423,822, filed Oct. 18, 1989, titled MICROCOMPUTER-CONTROLLED ELECTRONIC POSTAGE METER HAVING PRINT WHEELS SET BY SEPARATE MOTORS, Ser. No. 423,813, filed Oct. 18, 1989, titled MICROCOMPUTER-IMPLEMENTED CONTROL OF SEPARATE D.C. MOTORS FOR SETTING A PLURALITY OF POSTAGE METER PRINT WHEELS; and application Ser. No. 423,330, filed Oct. 18, 1989, titled TWO STAGE QUADRATURE INCREMENTAL ENCODER now U.S. Pat. No. 5,021,781. The disclosures of those three applications are incorporated herein by reference.

BACKGROUND OF THE INVENTION

The invention disclosed herein relates to detection of, and accounting for, unauthorized postage printing in an electronic postage meter, particularly a postage meter having print wheels that are not locked against rotation when power to the postage meter is switched off.

One type of known electronic postage meter includes a plurality of individually settable print wheels mounted to a print drum which is rotated to print the postage value of the digits set in the print wheels. To prevent fraudulent postage printing, i.e., printing without accounting for the postage, the postage meter accounts for print cycles (each rotation of the print drum) both when power to the postage meter is on and off. Manual rotation of the print wheels and the print drum are prevented by the drive mechanisms for the print wheels and drum when power to the postage meter is on, thereby preventing postage printing without accounting while power is on. To deter fraudulent postage printing when power to the meter is off, the meter includes a cover or shroud which limits access to the print wheels and print drum. However, the cover or shroud does not lock the print drum or the print wheels.

It has been found that fraudulent postage printing can be prevented by providing a locking mechanism that locks the print wheels against rotation when power to the postage meter is off. Postage printing by the locked print wheels may be accounted for by recording the digit values of the print wheels when power to the meter is switched off and by detecting, when power is switched on again, rotation of the print drum which occurred when power to the meter was off. In this way, postage values can not be set when the meter is off, but if the print drum is rotated when the meter is off, postage will be accounted.

The tamper-resistant cover or shroud referred to above while deterring tampering, performs no postage accounting function. Therefore, a postage meter in which the print wheels are not locked against rotation when power to the postage meter is off will not account for postage printed when the meter is off since the setting of the print wheels for each print cycle will not be unequivocally known. A postage meter of the type described above may not include a print wheel locking mechanism due to space considerations, such as in the postage meter described in the above-referenced patent applications.

The disclosures of the following U.S. patents are incorporated herein by reference: U.S. Pat. Nos. 4,630,210, 4,631,681, 4,635,205, 4,636,959, 4,646,635, 4,665,353, 4,638,732, 4,774,446 and 4,643,089, all of Salazar et al. and U.S. Pat. No. 4,731,728 of Muller. All of those patents are assigned to the assignee of this application. Those patents disclose an electronic postage meter including a plurality of print wheels mounted to a print drum.

There is thus a need to detect and account for postage printed by a postage meter that does not include a print wheel locking mechanism which prevents print wheel rotation while power to the postage meter was off.

SUMMARY OF THE INVENTION

It is an object of the invention disclosed herein to provide an improved electronically-controlled postage meter.

It is another object of the invention to provide an electronic postage meter which detects and accounts for postage printed when power to the meter is switched off without employing a mechanism to lock the meter printing devices when the meter is off.

It is another object of the invention to detect and prevent fraudulent postage printing in a postage meter of the type described in the previous object of the invention.

The above and other objects are achieved, in accordance with the invention, in a postage meter which may not include a print device locking mechanism that locks the print devices when power is off, which detects and accounts for postage printed while power to the meter was off, and which also may prevent continued fraudulent postage printing.

According to the invention, the postage meter determines print cycles of the postage meter occurring when power to the meter is off and whether the print devices were moved to a different postage value setting when the meter was off, and if so, the new setting of the print devices. From that, the postage meter determines whether postage was printed while power to the meter was off, and if so, accounts for the postage printed.

The postage meter prevents fraudulent postage printing by recording detection of each unauthorized postage printing while power to the meter was off, and then preventing normal meter operation when the number of detected unauthorized postage printings exceeds a predetermined number.

A method in accordance with the invention detects postage printed by a postage meter while the power to the meter was switched off and accounts for such printed postage. The postage meter includes means providing signals representing the incremental or relative positions (value settings) of the print devices. The method comprises: upon power being switched on to the meter, determining whether the print devices have undergone movement while power to the meter was off through a printing area of the meter at which the print devices normally print postage; determining the value settings of the print devices at the time that power to the meter is switched on; and recording as printed postage the value represented by the value settings of the print devices at the time that power to the meter is switched on if the print devices of the meter were determined to have been moved through the printing position while power to the meter was off.

A method in accordance with the invention detects postage meter tampering, and detects and accounts for postage printed by a postage meter while the power to the meter was off. That method comprises: upon power being switched on to the meter, determining whether the print devices have undergone movement while power to the meter was off through a printing area of the meter at which the print devices normally print postage; determining whether the value settings of the print devices changed while the power to the meter was off; recording as tampering a determination that the value settings of the print devices were changed; determining the value settings of the print devices at the time that power to the meter is switched on; recording as printed postage the value represented by the value settings of the print devices at the time that power to the meter is switched on if the print devices of the meter were determined to have been moved through the printing position while power to the meter was off.

A method in accordance with the invention prevents continued postage meter tampering or unauthorized postage printing occurring while power to the postage meter is off. That method comprises: upon power being switched on to the meter, determining whether print devices of the postage meter have undergone movement while power to the meter was off through a printing area of the meter at which the print devices normally print postage; determining whether the value settings of the print devices changed while the power to the meter was switched off; storing the number of times that the print device value settings have been determined to have been changed while power to the meter was off; and preventing postage meter operation when the number of A method in accordance with the invention detects postage meter tampering occurring while power to the meter is switched off, and detects and accounts for postage printing by the postage meter while the power to the meter was off. The method comprises: upon power being switched on to the meter, determining whether print devices of the postage meter have undergone movement while power to the meter was off through a printing area of the meter at which the print devices normally print postage; determining whether the value settings of the print devices changed while power to the meter was off including storing the print device value settings in a non-volatile memory when power to the meter is switched off, determining the print device value settings when power to the meter is switched on again, and comparing the stored value settings to the value settings when power to the meter is switched on; recording as tampering a determination that the value settings of the print devices were changed; and recording as printed postage the value represented by the value settings of the print devices at the time that power to the meter is switched on.

In a postage meter having the relative position signal means referred to above, determination of whether the value settings of the print devices changed comprises storing the print device value settings in a non-volatile memory when power to the meter is switched off, determining the print device value settings when power to the meter is switched on again, and comparing the stored value settings to the value settings when power to the meter is switched on.

The invention determines the actual position of the print devices when power is switched on in a postage meter having relative or incremental position encoders (relative position signal means) for the print device positions as opposed to absolute position encoders. According to the invention, the print device settings when power is switched on to the meter are determined by moving respective print devices from their respective actual positions when power is switched on to at least one known reference position, determining the travel of the respective print device from its actual position to the at least one reference position, and from that travel, determining the actual position of the respective print device.

In accordance with the invention, an electronic postage meter which includes a plurality of settable print devices which are movable through a printing area to print postage on a mail piece disposed in the area is improved to include means for carrying out the functions in the methods described above In a preferred embodiment, a microcomputer comprises such means.

The above and other objects, aspects, features and advantages description of the preferred embodiments thereof taken in conjunction with the accompanying drawings and appended claims.

BRIEF DESCRIPTION OF THE DRAWINGS

The invention is illustrated by way of example and not limitation in the figures of the accompanying drawings in which like references denote the same or corresponding parts, and in which:

FIG. 7 is a flow chart of the routine in the flow chart of FIG. 6 which determines the actual setting of the postage meter print wheels upon switching power to the postage meter.

DESCRIPTION OF THE PREFERRED EMBODIMENTS

Figure 1:
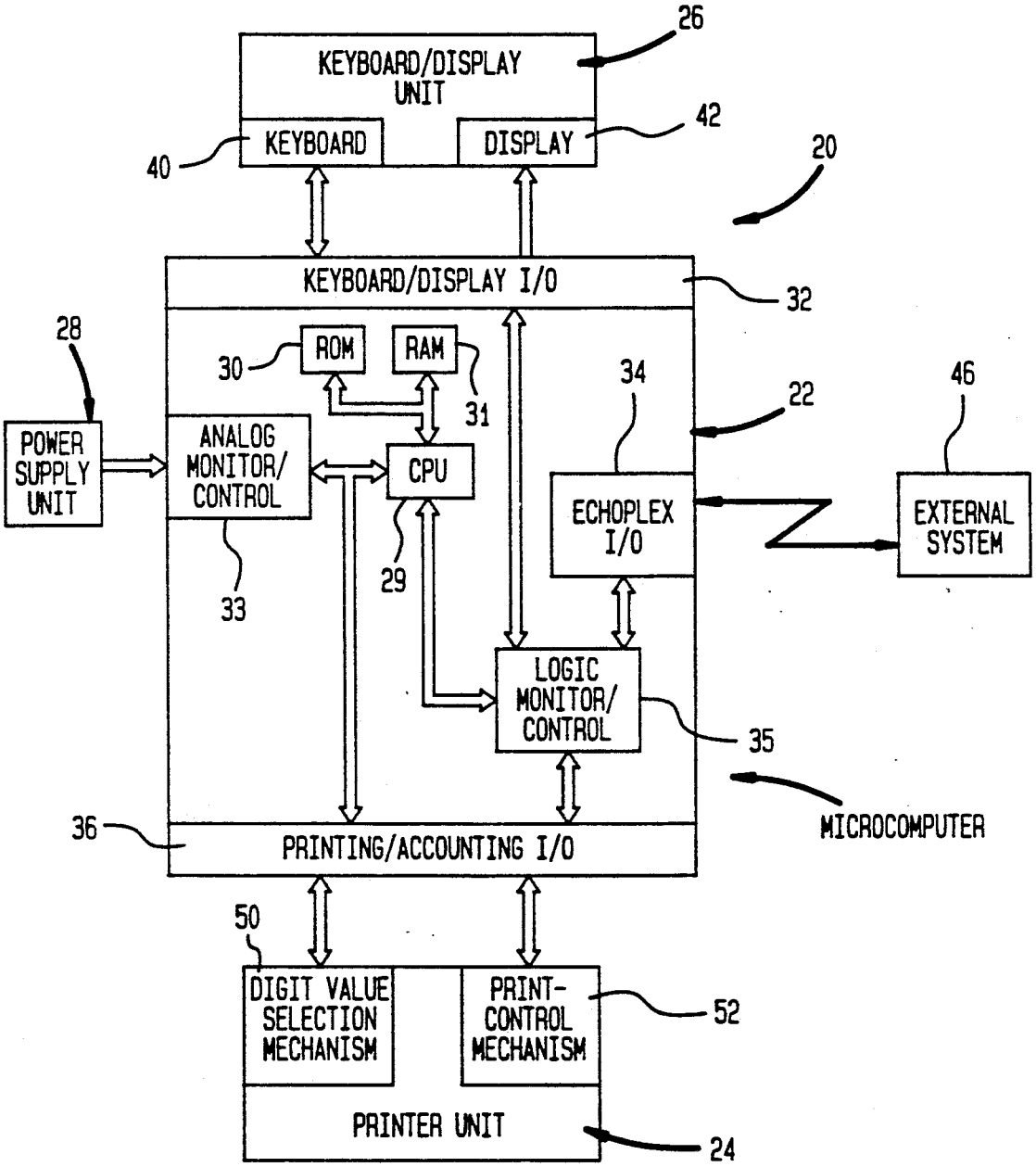
FIG. 1 is a block diagram of an electronic postage meter including a microcomputer and incorporating the present invention.

Postage meter 20 (FIG. 1) incorporating the present invention includes a microcomputer 22, a printer unit 24, a keyboard/display unit 26 and a power supply unit 28. Microcomputer 22 includes a CPU 29, read only memory (ROM) 30 including non-volatile ROM, random access or read/write memory (RAM) 31 including battery backed-up RAM (non-volatile RAM), and the following input/output ("I/O") circuitry: keyboard-/display I/O 32; analog monitor/control 33; echoplex I/O 34; logic monitor/control 35 and printing/accounting I/O 36.

Keyboard display unit 26 includes a keyboard 40 for entering postage values and commands for operating postage meter 20, and a display 42 for displaying postage values, commands, messages, etc. Keyboard/display I/O 32 provides an interface for exchange of signals between keyboard 40 and display 42, and microcomputer 22.

Analog monitor/control 33 monitors analog functions and controls accounting. It receives various regulated and unregulated voltages from power supply unit 28 for powering microcomputer 22 and for monitoring power supply unit 28, and also receives various signals and outputs various signals internal to microcomputer 22 for ensuring failsafe operation and postage accounting of postage meter 20 Echoplex I/O 34 controls an optical input/output port by means of which microcomputer 22 communicates with an external system 46 such as a central system for downloading postage funds to meter 20 and uploading postage usage information from meter 20. Echoplex I/O 34 (including an optical interface) provides complete electrical isolation of microcomputer 22 from any external system 46 coupled thereto via echoplex I/O 34.

Printer unit 24 includes a bank of print wheels 62 (see FIG. 2, not shown in FIG. 1) mounted to a print drum 65 for printing postage indicia on mail pieces, a digit value selection mechanism 50 which sets the print wheels to print a selected postage value and a print control mechanism 52 which causes the print drum to print the postage value set on the print wheels on a mail piece and monitors structure in printer unit 24 to ensue that postage meter 20 does not print without accounting and doe not account without printing. Printing/accounting I/O 36 provides an interface for exchange of signals between digit value selection mechanism 50, print control mechanism 52 and microcomputer 22.

Microcomputer 22 includes a single microprocessor 29 (CPU), ROM 30 for the microcomputer program, RAM 31 for program data, the non-volatile memory ("NVM") in ROM 30 and RAM 31 in the form of electrically erasable ROM (EEROM) and battery backed-up RAM, analog monitor/control 33, logic monitor/control 35 which monitors logic functions and performs input/output control and decoding, the echoplex optical interface referred to above (not shown), printing/accounting I/O 36 and keyboard/display I/O 32.

Microcomputer 22 is a uniprocessing system which via programming in ROM 30, program data in the RAM 31 and I/O's 32–36 sequentially periodically polls postage meter activities and during each poll reacts to the stimulus received from the polled activity, i.e., executes in response to the received stimulus and the stored program.

In the presently preferred embodiment, microcomputer 22 is an 8-bit single board microcomputer with an 8-bit multiplexed bus structure in which the CPU 29 is embodied by an NSC800 integrated circuit.

Further description of postage meter 20 may be found in application Ser. No. 423,822, referenced above.

Figure 2:
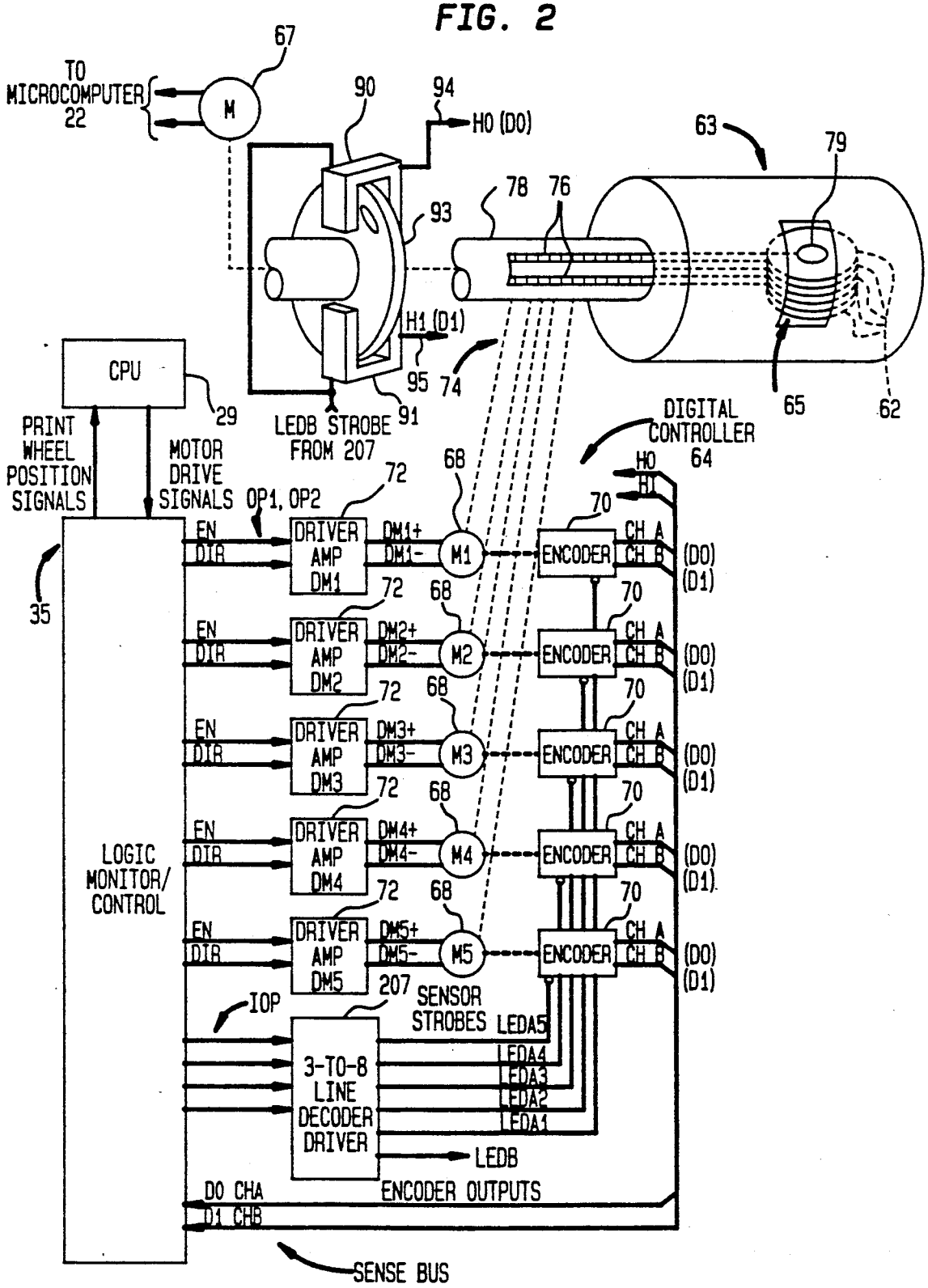
FIG. 2 is a block diagram of servo control loops implemented by the microcomputer depicted in FIG. 1, d.c. motors and incremental position encoders for setting postage value print wheels in the postage meter of FIG. 1.

Referring to FIG. 2, postage meter 20 includes a plurality of print wheels 62, mounted to a print drum 63, whose position are set by a digital controller 64. Controller 64 includes microcomputer 22, (CPU 29 and logic monitor/control 35), d.c. motors 68 (one for each print wheel 62), incremental (relative) position encoders 70 (one for each d.c. motor 68), and motor drive amplifiers 72 (one for each d.c. motor 68). If desired, drive amplifiers 72 may be provided as part of microcomputer 22. Each motor 72 drives a print wheel 62 through gearing 74 and first and second rack and pinion drives (not shown). Pinion gears (not shown) of the first rack and pinion drive are coupled to racks 76 disposed in print drum shaft 78, and racks 76 are coupled to pinion gears 79 of the second drive which are in turn coupled to print wheels 62. Each motor 68 is operated via a closed servo loop implemented in part by microcomputer 22, drive amplifiers 72 and encoders 70. Digital controller 64 contains five parallel software driven servo systems, a function block diagram 80 of each of which is depicted in FIG. 3.

Print drum 63 is rotated through a printing area 65 by a motor 67 controlled by microcomputer 22.

Servo loop 80 (FIG. 3) is basically a digital servo system, i.e., a closed-loop position controller. Each servo loop 80 includes the following: a motion profile and timing control 82 (W), a summing junction 83, a digital compensation control or filter 84 (Dz), a pulse width modulator (PWM) 85 (Kpwm), drive amplifier 72 (Ka), encoder 70 and an encoder state quadrature decoder and counter 86 (Kp). The drive amplifier 72 is shown incorporated within the microcomputer 22, but may physically be located externally of the microcomputer 22 as shown in FIG. 2 depending on space requirements, etc.

Figure 3:
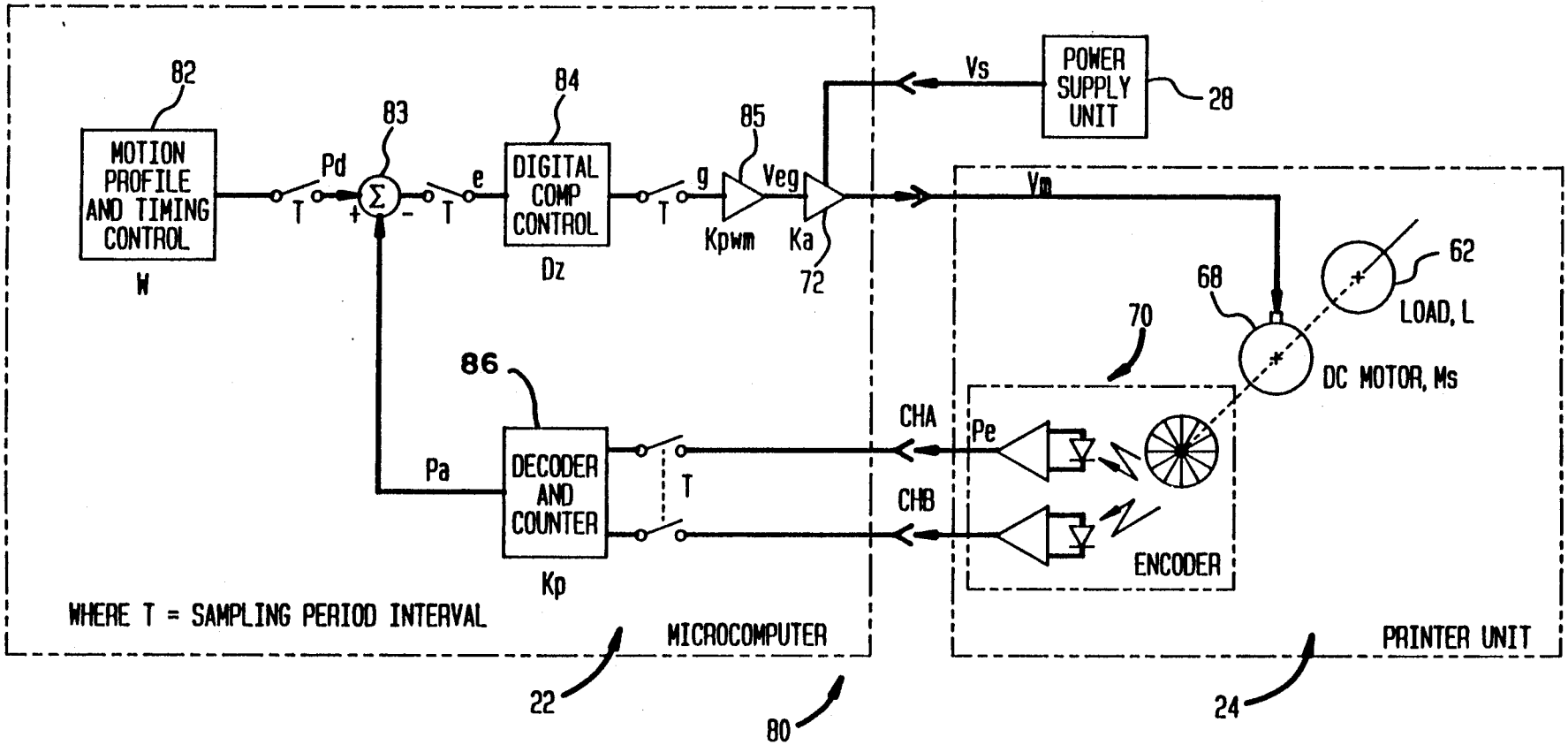
FIG. 3 is a functional block diagram of the servo loop for controlling each d.c. motor, the loop being implemented in part by the microcomputer depicted in FIG. 2.

Motion profile and timing control 82, summing junction 83, digital compensation control 84, pulse width modulator 85 and encoder state quadrature decoder and counter 86 illustrated in FIG. 3 as hardware are implemented by microcomputer 22 and software, as described in Ser. No. 423,822. Encoder 70 provides digital signals directly and PWM circuit 85 provides digital d.c. motor drive signals so that loop 80 does not require an analog-to-digital converter and a digital-to-analog converter. Desired position information contained in motion profile and timing control 82 may be entered by means of keyboard 40 or entered from an external system 46.

Figure 4:
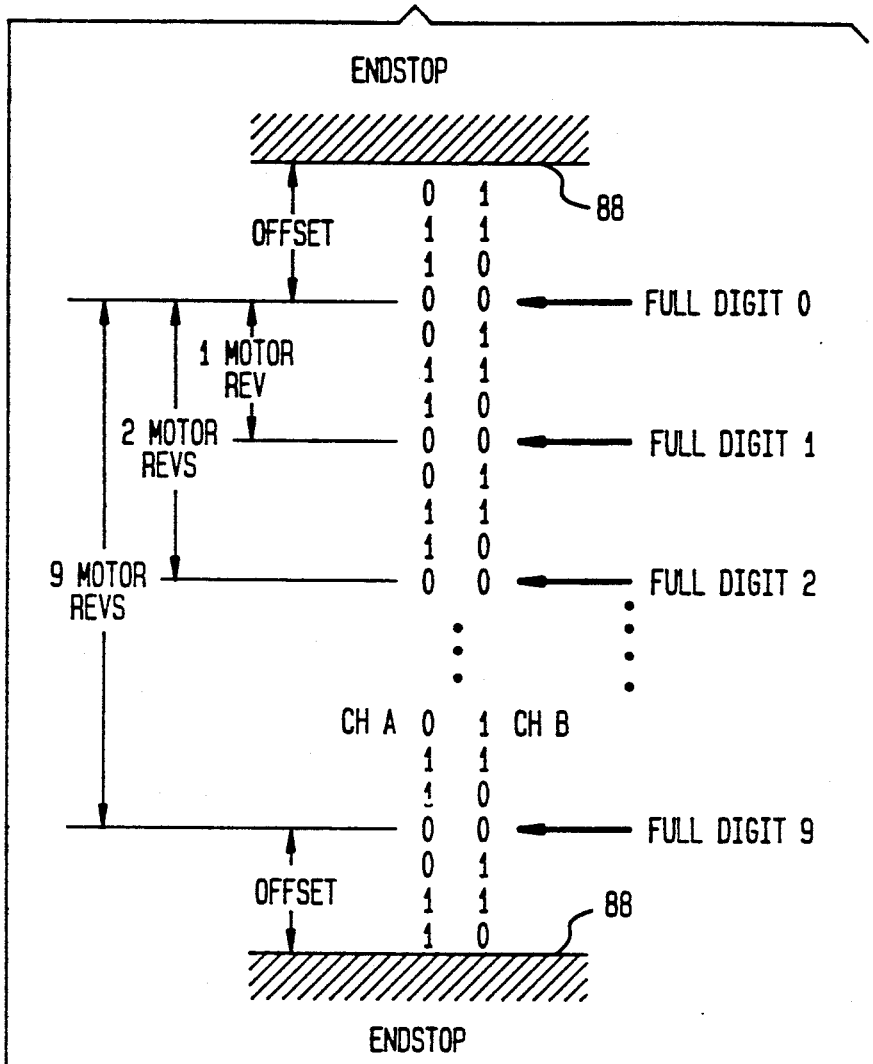
FIGS. 4 and 5 are diagrams illustrating the relationship of the output signal of the incremental encoder of the servo loop depicted in FIGS. 2 and 3 and the corresponding d.c. motor shaft position.
Figure 5:
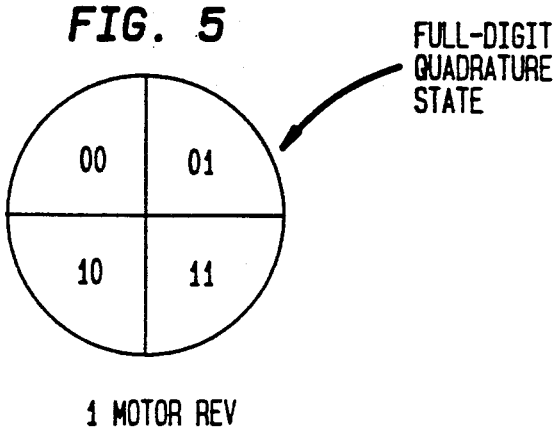

Referring to FIGS. 4 and 5, one revolution of motor 68 corresponds to a full-digit print wheel state, and nine motor revolutions are required to set a print wheel 62 to all of its digit values, 0–9. Correspondingly, an encoder transition is equal to one quarter motor revolution. Each print wheel 62 is rotatable between end stops 88 offset from the "0" and "1" digits by a maximum offset distance corresponding to one half motor revolution, which in turn corresponds to a maximum of three encoder transitions. All full digit print wheel states are "00" states.

A relative incremental encoding scheme is used in control loop 80 where the endstop position for each print wheel is used as the reference point. Upon power up, or system reset, all the print wheel positions are verified relative to these endstop positions. The print wheel digits are set to all zeros, then, set to all nines, and then, back to all zeros.

Encoder quadrature decoder and counter 86 (Kp) in servo 80 loop transforms the motor shaft position into a digital count through the two-channel output of encoder 70. At every sampling instant T, the encoder output is read. Then, the quadrature state is decoded, and depending on the state sequence direction (i.e., digit increasing or digit decreasing), shown in Table I below, an actual position counter Pa in decoder and counter 86 is incremented or decremented from its initial value. Hence, the count value is an incremental number of encoder state transitions relative to the initial value of the counter Pa. In case of the quadrature decoding error of counting two transitions in a sampling interval (due to electrical noise, or, encoder/motor deviations accepted tolerance), an incremental count of 0 is taken which forces a positioning error to be detected at the end of the motion.

The digital compensation control 84 is a control routine derived from a lead/lag compensation filter design for the closed-loop system 80 shown in FIG. 3. Its output, g(Tn), at every sampling instant T, is a discretized filter output to correct the loop error and provides the desired damping characteristics. The control routine is basically a PID controller (proportional-integral-derivative).

The output of digital compensation control 84 is transformed into a pulse width modulated (PWM) signal in pulse width modulator 85 which generates or updates the PWM signal for the five digital compensation controls.

A microcomputer implemented control loop for controlling a d.c. motor is described in the patents and patent applications referenced above. Those patents and patent applications further disclose algorithms by which the digital compensation control 84 (or a lead/-lag filter) is implemented, and algorithms by means of which the d.c. motor is controlled. As stated above, the disclosures of each of the patents and patent applications cited above is incorporated herein by reference. Thus, those of skill in the art by means of the disclosure herein and in those patents and patent applications may construct programs implementing the digital compensation control or lead-lag filter 84, the pulse width modulator 85 and the encoder quadrature decoder and counter 86.

Referring to FIG. 2, print drum 63 is rotated between home positions by motor 67 to print the postage set on the print wheels 62 on a mail piece presented in area 65. Sensors 90 and 91 detect the two home positions of print drum 63. Sensors 90 and 91 may be optical sensors which sense the position of an optical variation (e.g. hole) in a wheel 93 connected to shaft 78 of print drum 63 For example, print drum 63 may be in one home position when the outputs 94, 95 of sensors 90, 91 are "01" and in the other home position when outputs 94, 95 are "10". When outputs 94,95 are "11", drum 63 is in a rotated position between home positions.

As pointed out above, postage meter 20 does not include a mechanism to lock the print wheels 62 when power to meter 20 is off. Thus, it is possible to alter the settings of print wheels 62 when the meter is off and rotate drum 63 to print postage without authorization. In accordance with the invention, such unauthorized postage printing is accounted for when power to meter 20 is next turned on. Specifically, microcomputer 22 is programed to execute the methods flow charted in FIGS. 6 and 7 upon power turn on of meter 20 to detect a change in the setting of print wheels 62 occurring while power to meter 20 was off, and to account for any printing of postage indicated by a print cycle, i.e., rotation of print drum 63 from one home position to the other. The method flow charted in FIG. 6 also prevents continued fraudulent postage printing by preventing normal meter operation that an excessive number of postage printings occurred when power to the meter was off.

Figure 6:
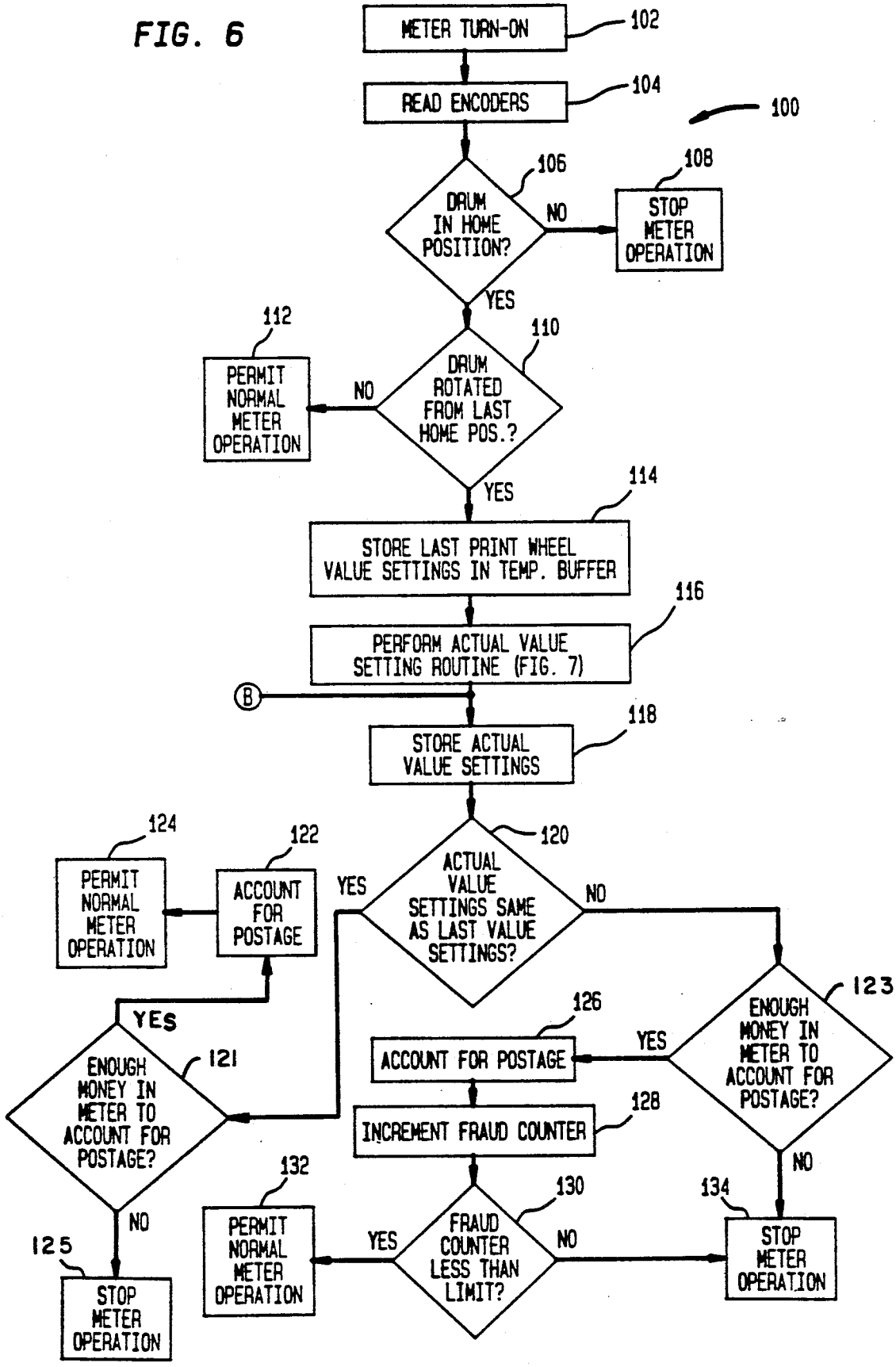
FIG. 6 is a flow chart showing operation of the postage meter incorporating the present invention to detect and account for postage printed when power to the postage meter is off and to prevent continued fraudulent postage printing.

Referring to FIG. 6, routine 100, illustrating methods according to the invention, are carried out by meter 20 to detect tampering and account for printed postage. After meter 20 is turned on (step 102), encoders 70 (sensors 90, 91) are read by microcomputer 22 (step 104). In step 106, microcomputer 22 determines whether print drum 63 is in one of its home positions, i.e., whether it has completed a revolution. If the home sensors 90, 91 indicate that print drum 63 has not completed its revolution, i.e., it is not in a home position, that is concluded in step 108 to be determinative of tampering or a fatal system malfunction since more than enough time has passed for the print drum to complete its cycle, and meter 20 is prevented from operating. If drum 63 is in a home position, then meter 20 determines in step 110 whether drum 63 has been rotated from its last home position, i.e., whether a print cycle took place while power to meter 20 was switched off. This is determined by comparing the home position at power turn on to the home position entered into the non-volatile memory ("NVM") in RAM 31 at power turn off. If no print cycle has taken place, then meter 20 concludes in step 112 that no tampering took place when power to the meter was off and no fatal system fault is present, and normal meter operation is permitted. If a print cycle has taken place, then meter 20 determines in the following steps whether the setting of the print wheel has changed since power to the meter was last switched off and accounts for any postage printed. In step 114, the value settings of print wheels 63 when power to meter 20 was turned off are transferred from RAM NVM (where they are stored when the meter is turned off) to a temporary buffer. In step 116, meter 20 performs an actual print wheel value setting routine flow charted in FIG. 7 to determine the present value settings of the print wheels. The actual print wheel value settings determined in step 116 are stored in the RAM NVM in step 118. Meter 20 in step 120 then determines whether the actual digit value settings of the print wheels are the same as the last values stored in the temporary buffer. If they are, then meter 20 concludes that there has not been unauthorized printing and ascertains whether enough funds remain in the meter to account for the transaction, decision block 121. If enough funds remain, meter 20 accounts for the postage in step 122 and permits normal meter operation to proceed in step 124. If at 121, meter 20 concludes that insufficient funds exist to account for the transaction, meter operation is stopped at block 125. If the values have changed, then meter 20 concludes that unauthorized printing has taken place and ascertains whether sufficient funds exist to account for the transaction, decision block 123. If funds are available the meter 20 accounts for the postage in step 126 and increments a fraud counter in the RAM NVM in step 128. If the fraud counter is below a predetermined limit, as determined in step 130, then normal meter operations are permitted in step 132. If the fraud counter exceeds the predetermined limit, then meter operation is stopped in step 134, so that further fraudulent postage printing is prevented. If at 123, meter 20 concludes that insufficient funds exist to account for the transaction, meter operation is stopped at step 134.

Actual digit value routine 116 is flow charted in FIG. 7. The following definitions apply to flow chart 116.

Variables and Constants:

$N_{max}$=Allowed number of tries.

$R_{max}$=Allowed number of retries.

Cu(n)=Transition up count.

Cu(n) =Transition up count varying from Cu(O)→ Cu($N_{max}$) stored in an up count Cu(n) array in NVM.

Cd(n)=Transition down count.

Cd(n)=Transition down count varying from Cd(1)→Cd($N_{max}$) stored in a down count Cd(n) array in NVM.

N=number of tries attempted so far indexed into the count arrays stored in NVM.

R=number of retries attempted so far indexed into count array stored in NVM.

XD_REG=actual digit value setting array store in NVM.

The transition count arrays, the number of tries count array, the number of retries count array and the actual digit value setting array are stored in NVM so if the power is lost while searching for the actual digit value setting, the routine can pick up where it left off when the power is returned.

The printwheels are moved one quadrature state transition at a time so that if the power is lost there will be no coasting of the wheel through another transition like there would be if the wheels were driven at full power. As described above, it takes four transitions to move from one digit to the next digit on the wheel.

The number of tries N and retries R to determine the setting of a particular print wheel are limited and kept track of in respective counters in microcomputer 22.

Referring to FIG. 7, step 150 of routine 116 clears the number of retries (R) (stored in the retry counter) attempted so far to determine the setting of a particular print wheel. Step 152 determines whether power was lost while searching for the actual position of a particular wheel. If power was lost, step 154 determines whether the number of tries (N) stored in RAM NVM exceeds the maximum ($N_{max}$) or not. If it does, then the digit value setting for that wheel previously stored in RAM NVM on the last cycle through routine 116 is set in the XD_REG array. If the digit value of all wheels has been set (step 158), routine 116 then proceeds to (B) (step 118 in FIG. 6). If not, the routine reverts to (A), i.e., step 150. If the number of tries N does not exceed the maximum ($N_{max}$) in step 154, or power was not lost (step 152), then routine 116 proceeds to step 160 in which the particular print wheel is moved down by one encoder transition state.

Step 162 determines whether the move was successful, i.e., whether encoder 70 proceeds to the next transition state. If the move was successful, then the Cd(n) count array is incremented in step 164 and the same print wheel is moved down another transition in step 160. When in step 162 the move is determined not successful, i.e., encoder 70 does not output the next transition state, then step 166 determines whether the Cd(n) down count in the count down array is less than the Cu(n) up count in the count up array minus 1, i.e. whether $Cd(n)<Cu(n)-1$. This indicates whether the wheel can move down as many transitions as it was previously moved up. If $Cd(n)<Cu(n)-1$ in step 166, then the number of retries R is incremented in step 168. If the number of retries R equals ($R_{max}$) in step 170, then the actual digit value is stored for that wheel (set digit value setting in XD_REG) in step 156 and the routine determines in step 158 whether the digit values have been set for all wheels. The routine then proceeds to A or B as described above for step 158. If in step 170, R is not equal to $R_{max}$, the routine reverts to step 160 in which the print wheel is moved down another increment. If in step 166 Cu(n) is not less than Cu(n)−1, the particular wheel is moved up one transition in step 172.

Step 174 is similar to step 162 and determines whether the move was successful. If it was, the number of tries N is incremented in step 176. If in step 178 the number of tries N equals $N_{max}$, then the routine proceeds to step 156 in which the digit value for that wheel is set in the XD_REG array equal to the stored digit value for that wheel and the routine in step 158 proceeds to A or B depending on whether the values for all wheels have been set. If in step 178, N is not equal to $N_{max}$, the routine reverts to step 160 in which the print wheel is moved down another increment. If the up incrementing of the print wheel was not successful in step 174, then in step 180 the up count Cu(n) in the count up array is incremented. If in step 182 the up count Cu(n) does not equal the number of transitions needed to move the wheel up to the digit "9", then the routine reverts to step 172 and the print wheel is moved up another transition. If the up count Cu(n) equals the number of transitions to move the wheel to the "9" digit, then the actual digit setting value is calculated from the transition count array in steps 184–190 as follows.

In step 184, a temporary variable X is set to 0. In step 186, the temporary variable X is set equal to the current number of down transitions minus the previous number of up transitions plus the previous value of the temporary variable X, i.e., $X=Cd(n)-(Cu(n-1)+X)$. In step 188 the number of retries R is decremented. In step 190, if the number of retries R is greater than zero, then step 186 is repeated. If it is not, then the routine proceeds to step 192 where meter 20 concludes that X equals the actual number of transitions needed to move from the digit value to which the wheel was set at turn on to the digit "zero". Then the actual digit setting value is set in the XD_REG array equal to the temporary variable divided by 4 (4 encoder transitions per digit) with the result truncated to the lower integer value, e.g., $3\frac{3}{4}$ becomes 3. The routine then reverts to step 156 to determine whether the values have been set for all wheels. If they have, the routine proceeds to (B); if they have not, the routine proceeds to (A).

Certain changes and modifications of the embodiments of the invention herein disclosed will be readily apparent to those of skill in the art. Moreover, uses of the invention other than in postage meters or other than in connection with print devices will also be readily apparent to those of skill in the art. It is the applicants' intention to cover by the claims all such uses and all those changes and modifications which could be made to the embodiments of the invention herein chosen for the purposes of disclosure which do not depart from the spirit and scope of the invention.

What is claimed is:

1. A method of detecting postage printed by print devices of a postage meter occurring while the power to the meter was switched off and accounting for such printed postage, the postage meter including means providing signals representing the relative positions of the print devices, said method comprising:

upon power being switched on to the meter, determining whether print devices of the postage meter have undergone movement while power to the meter was off through a printing area of the meter at which the print devices normally print postage;

determining the value settings of the print devices at the time that power to the meter is switched on; and recording as printed postage the value represented by the value settings of the print devices at the time that power to the meter is switched on if the print devices of the meter were determined to have been moved through the printing position while power to the meter was off.

2. A method of detecting postage meter tampering, and detecting and accounting for postage printed by print devices of a postage meter occurring while the power to the meter was off, comprising:

upon power being switched on to the meter, determining whether print devices of the postage meter have undergone movement the meter at which the print devices normally print postage;

determining whether the value settings of the print devices changed while power to the meter was off;

recording as tampering a determination that the value settings of the print devices were changed;

determining the value settings of the print devices at the time that power to the meter is switched on; and recording as printed postage the value represented by the value settings of the print devices at the time that power to the meter is switched on if the print devices of the meter were determined to have been moved through the printing position while power to the meter was off.

3. The method of claim 2 wherein the postage meter includes means providing signals representing the relative positions of the print devices, and wherein determining whether the value settings of the print devices changed comprises storing the print device value settings in a non-volatile memory when power to the meter is switched off, determining the print device value settings when power to the meter is switched on again, and comparing the stored value settings to the value settings when power to the meter is switched on.

4. A method of preventing continued postage meter tampering occurring while power to the postage meter is off, comprising:

upon power being switched on to the meter, determining whether print devices of the postage meter which print postage have undergone movement while power to the meter was off through a printing area of the meter at which the print devices normally print postage;

determining whether the value settings of the print devices changed while power to the meter was switched off;

storing the number of times that the print device value settings have been determined to have been changed while power to the meter was off; and preventing postage meter operation when said number of times exceeds a predetermined number.

5. The method of claim 4 wherein the postage meter includes means providing signals representing the relative positions of the print devices, and wherein determining whether the value settings of the print devices changed comprises storing the print device value settings in a non-volatile memory when power to the meter is switched off, determining the print device value settings when power to the meter is switched on again, and comparing the stored value settings to the value settings when power to the meter is switched on.

6. A method of detecting postage meter tampering occurring while power to the meter is switched off, and detecting and accounting for postage printing by print devices of a postage meter while the power to the meter was off, comprising:

upon power being switched on to the meter, determining whether print devices of the postage meter have undergone movement while power to the meter was off through a printing area of the meter at which the print devices normally print postage;

determining whether the value settings of the print devices changed while power to the meter was off including storing the print device value settings in a non-volatile memory when power to the meter is switched off, determining the print device value settings when power to the meter is switched on again, and comparing the stored value settings to the value settings when power to the meter is switched on;

recording as tampering a determination that the value settings of the print devices were changed; and recording as printed postage the value represented by the value settings of the print devices at the time that power to the meter is switched on if the print devices of the meter were determined to have been moved through the printing position while power to the meter was off.

7. The method according to claim 6 wherein the postage meter includes means providing signals representing the relative positions of the print devices, and wherein said step of determining the print device settings when power is switched on to the meter comprises moving respective print devices from their respective actual positions when power is switched to the meter to at least one known reference position, determining the travel of the respective print device from its actual position to the at least one reference position, and from that travel, determining the actual position of the respective print device.

8. In an electronic postage meter which includes a plurality of settable print devices which are movable through a printing area to print postage on a mail piece disposed in said area, and means providing signals representing the relative positions of the print devices, the improvement comprising detecting postage printed by the postage meter occurring while the power to the meter was switched off and recording such printed postage, said improvement comprising:

means, upon power being switched on to the meter, for determining whether print devices of the postage meter have undergone movement while power to the meter was off through said printing area of said meter; and means for determining the value settings of the print devices at the time that power to the meter is switched on; and means for recording as printed postage the value represented by the value settings of said print devices at the time that power to the meter is switched on if the print devices of the meter were determined to have been moved through the printing position while power to the meter was off.

9. In an electronic postage meter which includes a plurality of settable print devices which are movable through a printing area to print postage on a mail piece disposed in said area, the improvement comprising detecting postage meter tampering, and detecting and accounting for postage printed by said meter while power to said meter was off, said improvement comprising:

means, upon power being switched on to said meter, for determining whether print devices of said postage meter have undergone movement while power to the meter was off through said printing area of said meter;

means for determining whether said value settings of said print devices changed while power to said meter was off;

means for recording as tampering a determination that said value settings of said print devices where changed;

means for determining said value settings of said print devices at the time that power to said meter is switched on; and means for recording as printed postage said value represented by said value settings of said print devices at the time that power to said meter is switched on if the print devices of the meter were determined to have been moved through the printing position while power to the meter was off.

10. The postage meter of claim 9 wherein said postage meter includes means providing signals representing the relative positions of the print devices, said means for determining whether said value settings of said print devices changed comprises a non-volatile memory in which said print device value settings are stored when power to said meter is switched off, means for determining said print device value settings when power to said meter is switched on again, and means for comparing said stored value settings to said value settings when power to said meter is switched on.

11. The postage meter according to claim 9 wherein a microcomputer comprises all said means.

12. In an electronic postage meter which includes a plurality of settable print devices which are movable through a printing area to print postage on a mail piece disposed in said area, the improvement comprising preventing continued postage meter tampering while power to said postage meter is off, said improvement comprising:

means, upon power being switched on to said meter, for determining whether print devices of said postage meter have undergone movement through a printing area of said meter at which said print devices normally print postage when power to said meter was off;

means for determining whether said value settings of said print devices changed while said power to said meter was switched off;

means for storing said number of times that said print device value settings have been determined to be changed while power to said meter was off; and means causing said postage meter not to operate when said number of times exceeds a predetermined number.

13. The postage meter of claim 12 wherein said postage meter includes means providing signals representing the relative positions of the print devices, said means for determining whether said value settings of said print devices changed comprises a non-volatile memory in which said print device value settings are stored when power to said meter is switched off, means for determining said print device value settings when power to said meter is switched on again, and means for comparing said stored value settings to said value settings when power to said meter is switched on.

14. The postage meter according to claim 12 wherein a microcomputer comprises all said means.

15. In an electronic postage meter which includes a plurality of settable print devices movable through a printing area to print postage on a mail piece disposed in said area, the improvement comprising detecting postage meter tampering, and detecting and accounting for postage printed by said postage meter while power to said meter was off, said improvement comprising:

means, upon power being switched on to said meter, for determining whether print devices of said postage meter have undergone movement while power to said meter was off through said printing area of said meter;

means for determining whether said value settings of said print devices changed while power to said meter was off including a non-volatile memory in which said print device value settings are stored when power to said meter is switched off, means for determining said print device value settings when power to said meter is switched on again, and means for comparing said stored value settings to said value settings when power to said meter is switched on;

means for recording as tampering a determination that said value settings of said print devices were changed; and means for recording as printed postage said value represented by said value settings of said print devices at said time that power to said meter is switched on if the print devices of the meter were determined to have been moved through the printing position while power to the meter was off.

16. The postage meter according to claim 1 wherein said postage meter includes means providing signals representing the relative positions of the print devices, said meter includes means determining the relative positions of said print devices, and wherein said means for determining said print device settings when power is switched on to said meter comprises means for moving respective print devices from their respective actual positions when power is switched on to at least one known reference position, and means for determining said travel of said respective print device from its actual position to said at least one reference position, and means for determining from that travel said actual position of said respective print device.

17. The postage meter according to claim 16 wherein a microcomputer comprises all said means.

* * * * *